US007485022B2

(12) United States Patent
Starr

(10) Patent No.: US 7,485,022 B2
(45) Date of Patent: Feb. 3, 2009

(54) METHOD AND APPARATUS FOR SURF SKIING

(76) Inventor: Jason Michael Starr, 819 D St., Salida, CO (US) 81201

( * ) Notice: Subject to any disclaimer, the term of this patent is extended or adjusted under 35 U.S.C. 154(b) by 131 days.

(21) Appl. No.: 11/067,182

(22) Filed: Feb. 26, 2005

(65) Prior Publication Data

US 2005/0215139 A1 Sep. 29, 2005

Related U.S. Application Data

(60) Provisional application No. 60/551,695, filed on Mar. 10, 2004.

(51) Int. Cl.
*B63B 35/81* (2006.01)
*B63B 35/83* (2006.01)

(52) U.S. Cl. ..... 441/65; 441/68; 441/70

(58) Field of Classification Search ..... 441/65, 441/68–79

See application file for complete search history.

(56) References Cited

U.S. PATENT DOCUMENTS

| | | | | | |
|---|---|---|---|---|---|
| 3,181,861 | A | * | 5/1965 | Wilkinson | 472/13 |
| 3,486,463 | A | * | 12/1969 | St. Cyr | 104/173.2 |
| 3,877,409 | A | | 4/1975 | Krogseng | |
| 3,929,549 | A | | 12/1975 | Smith | |
| 3,952,353 | A | * | 4/1976 | Word | 441/76 |
| 4,353,307 | A | * | 10/1982 | Munson | 104/183 |
| 4,527,984 | A | | 7/1985 | Gilbert | |
| 4,792,260 | A | | 12/1988 | Sauerbier | |
| 4,798,549 | A | | 1/1989 | Hirsch | |
| 4,867,721 | A | | 9/1989 | Fisher | |
| 4,952,184 | A | | 8/1990 | Graziano | |
| 5,181,332 | A | | 1/1993 | Uren et al. | |
| 5,334,065 | A | | 8/1994 | Uren et al. | |
| 5,366,182 | A | * | 11/1994 | Roeseler et al. | 244/155 R |
| 5,785,566 | A | | 7/1998 | Blanger | |
| 5,860,766 | A | * | 1/1999 | Lochtefeld et al. | 405/79 |
| 5,897,408 | A | | 4/1999 | Goode | |
| 5,911,190 | A | * | 6/1999 | Lochtefeld et al. | 114/274 |
| 6,017,256 | A | | 1/2000 | Gillis et al. | |
| 6,053,522 | A | | 4/2000 | Fogarty et al. | |
| 6,491,589 | B1 | | 12/2002 | Lochtefeld | |
| 7,156,714 | B2 | * | 1/2007 | Kian et al. | 441/74 |
| 2001/0053642 | A1 | | 12/2001 | Chao | |
| 2003/0017769 | A1 | | 1/2003 | Rosen | |
| 2003/0203686 | A1 | | 10/2003 | Rothschild | |

FOREIGN PATENT DOCUMENTS

| | | | | |
|---|---|---|---|---|
| AU | 2003203913 | A1 | * | 12/2003 |
| DE | 10310246 | A1 | * | 9/2004 |
| GB | 901112 | A | * | 7/1962 |
| JP | 07223585 | A | * | 8/1995 |

* cited by examiner

*Primary Examiner*—Ajay Vasudeva

(57) ABSTRACT

The present invention relates to a method and apparatus for surf skiing. The method includes attaching a surf ski to each foot of a surf skier and using the force and momentum of a wave alone to propel the surf skier.

18 Claims, 7 Drawing Sheets

METHOD AND APPARATUS FOR SURF SKIING

PRIORITY CLAIM

This application claims the benefit of priority to U.S. Provisional Application Ser. No. 60/551,695, filed Mar. 10, 2004. The disclosure of U.S. Provisional Application Ser. No. 60/551,695 is incorporated by reference in its entirety.

FIELD OF THE INVENTION

The present invention relates to a method and apparatus that allows a human subject to surf ski using the forces generated by waves in a motion similar to downhill (or alpine) snow skiing.

BACKGROUND OF THE INVENTION

Currently, most mediums upon which board sports are practiced have a sideways-stance option and a forward-stance option. On snow, the sideways-stance option is snowboarding, while the forward-stance option is skiing. Using a motorized boat on water, the sideways-stance sport is wakeboarding, and the forward-stance sport is water skiing. On pavement, the sideways-stance sport is skateboarding and the forward-stance sport is inline skating, or rollerblading. On surf, the sideways-stance sport is surfing. The present invention creates the forward-stance option for the medium of surf.

U.S. Pat. Nos. 4,952,184; 3,877,409; and 4,527,984 show self-propelled, non-motorized water skis. Additionally, Pre-Grant Publication Nos. U.S. 2003/0203686; U.S. 2003/0017769; U.S. 2001/0053642; show self-propelled water skis for the explicit purpose of walking on water. The self-propelled water skis in the prior art are suitable for slow, measured movement over generally flat water. In general, these devices teach away from the present invention, because they seek to simulate walking or cross country skiing—a slow, grounded endeavor—on water, whereas the present invention seeks to simulate alpine skiing on water. Alpine skiing is a dynamic sport involving angulated turns and aerial maneuvers. The present invention provides a means for a person to ski an ocean wave like an alpine snow skier skis mountain terrain.

Furthermore, the prior art devices are too large and cumbersome for use on an ocean wave. They do not provide the same turning ability as the surf skis of the present invention nor do they have sufficient maneuverability to perform on a wave. The field of self-propelled water skis teaches away from the current invention because, as explicitly shown, these devices use the force created by the motion of walking or skating, as captured by various flaps, fins and rudders against the water, to make the skis move. The current invention, however, uses the force of an ocean wave to propel the skier and allow him to float, turn and perform aerial maneuvers.

U.S. Pat. No. 4,867,721 shows traditional water skis. Water skiers have used the force created by a motorized boat (to which the skier is connected by a rope) as a means to make a water ski move and float. The traditional water ski will plane on a surface of water, supporting a person, upon reaching a certain speed. Traditional water skiers are towed behind a boat at speeds generally ranging from about 20-40 miles per hour. Traditional water skis are optimized for performance with a boat providing the sole motive force. Waves, in general, provide slower speeds than a motor boat.

SUMMARY OF THE INVENTION

The present invention provides a novel method and apparatus for harnessing the force and momentum created by waves to make the surf skier move and float.

The surf skis of the present invention use floatation properties similar to those of a surfboard, providing more floatation than traditional water skis, so that the surf skier can float and move on different sized waves and at different speeds, including slower speeds.

The present surf skis also are constructed with sharp edges that allow the surf ski to turn and maneuver like an alpine snow ski (FIG. 4).

DETAILED DESCRIPTION OF THE INVENTION

Figure 1A:
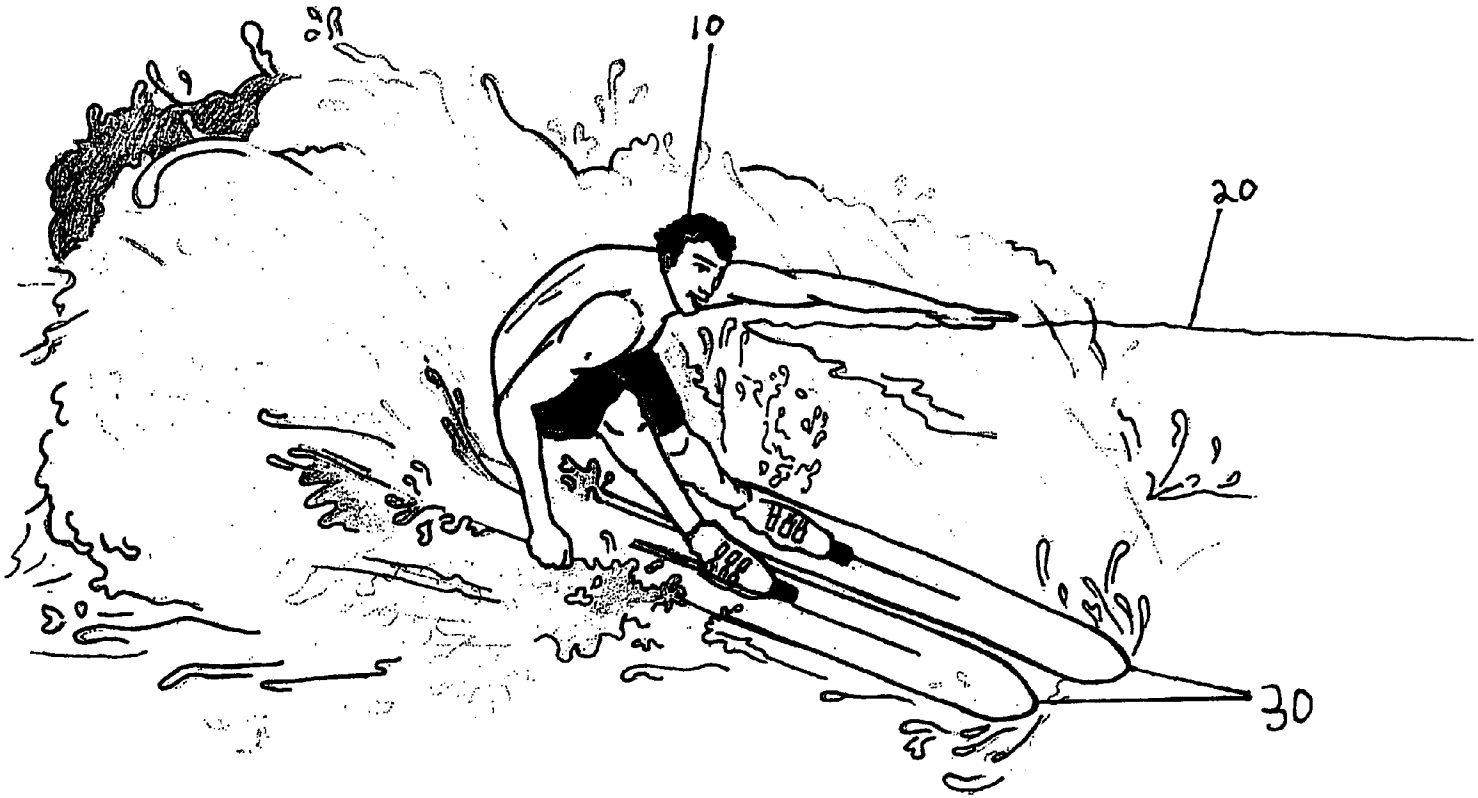
FIG. 1*a* shows a surf skier riding a mature wave.

According to the present invention, a surf skier (10) uses the force and momentum created by a wave (20) to ride a pair of surf skis (30), one for each foot (FIG. 1*a*).

The surf skis (30) have buoyancy properties similar to those of a surfboard, using reinforced foam as a core cased in a fiberglass shell as is known in surfboard construction and shown in U.S. Pat. Nos. 4,798,549 and 3,929,549, incorporated herein by reference. This increased buoyancy is important to allow the surf skier (10) to float at varying speeds. The greater buoyancy of surf skis (30), as compared to traditional water skis, allows the surf skier (10) to float, move and turn on small and large waves, where the speed of the skier would likely not exceed 35 miles per hour and go as low as about 10 miles per hour. The core material is also low in weight, which increases the maneuverability and control of the surf skis (30).

Of course, other materials may be used for the core as long as the materials provide the required buoyancy and low weight. This also includes an inflatable bladder that may be filed with ambient air, or other gas that has a lower density than the water, such as helium. This embodiment would require a nozzle to allow for inflation and deflation of the bladder positioned on the exterior of the shell. Placement of the nozzle should not interfere with the rider or increase drag in the water.

Of course, other materials may be used for the shell as long as the materials provide the required durability, strength and mounting capability. These include polymers and other composite materials.

Additionally, the surf skis (30) may have a fin or rudder (not shown), similar to those on surfboards, which increase control and maneuverability.

As taught in U.S. Pat. No. 5,911,190, incorporated herein by reference, a surfer uses a board to ride down the face of a wave because gravity pulls the rider down the incline created by the swell of the wave.

The present invention uses the same principle, with two surf skis (30) attached to the rider's (10) feet and a forward-facing stance. In the present invention, however, in order to maintain control of the surf skis (30), it is necessary to use a binding mechanism (40) for attaching each foot to its ski. Merely standing barefoot on surf skis while riding a wave would not provide the surf skier enough individual control over the pair of surf skis to maneuver. This is very different from surfing, where the rider is not attached to the surfboard, but rather is free to move on the board to maneuver and balance, and additionally lay prone on the surfboard. The prone position is used in surfing to paddle into position where waves are breaking and to paddle to gain an initial velocity when catching a wave, as is known in the art. The fact that a surf skier's feet need to be attached to the surf skis (30) is a major difference between the present sport and surfing.

U.S. Pat. Nos. 5,785,566; 5,334,065; and 5,897,408, incorporated herein by reference, describe several releasable binding mechanisms (40) that would be appropriate for the required attachment in surf skiing. These binding mechanisms (40) allow for a secure attachment to the surf skis (30), needed for riding and maneuvering on a wave. They also provide a means for detaching the binding (40) from the ski (30) when a certain amount of pressure is applied, as in the case of a fall. This is very much the same process that alpine (snow) skis and bindings work under.

Further, U.S. Pat. Nos. 6,017,256, 6,053,522 and 5,181,332 show nonreleasable bindings that could be used on surf skis. These are rigid boot systems, much like those used in traditional water skiing, that allow the necessary stability to ride and maneuver on a wave but do not release in the case of a fall.

The surf skis themselves (30) are constructed with a carving means (70), comprising sharp edges (73) at the intersection of the bottom surface (37) and the top surface (36) that allow the surf skis (30) to turn and maneuver like alpine snow skis. In alpine skiing, the principal of carving is well known. Alpine skis have sharp edges to allow the alpine skier to carve the edges of the skis into the snow surface to perform turns, maintain control and maneuver. The present invention uses the same principle, on a different medium: surf. The edge angle may range from 70 to 90 degrees. More preferably the edge angle may range from 80 to 90 degrees. More preferably the edge angle may range from 85 to 90 degrees. The sharp edges (73) of the surf skis (30) allow the surf skier (10) to carve the edges (73) of the surf skis (30) into waves (20) to perform turns, maintain control and maneuver. The sharp edges (73) of the present invention are different from the prior art traditional water skis, which have rounder edges.

Addressing the shape more specifically, as is well known in the design of other aquatic floatation apparatuses such as surfboards, shell design parameters are determined in a give and take trade off to match the expected requirements of different users, including body mass, height and skill level. With this understanding, the following description should be understood as illustrative of the design principles involved rather than a definitive shell design, and is not intended to limit the scope of the invention.

The width of the ski allows for a comfortable, shoulder-width-apart stance, and the ski is long and buoyant enough to provide stability at varying speeds.

Figure 2A:
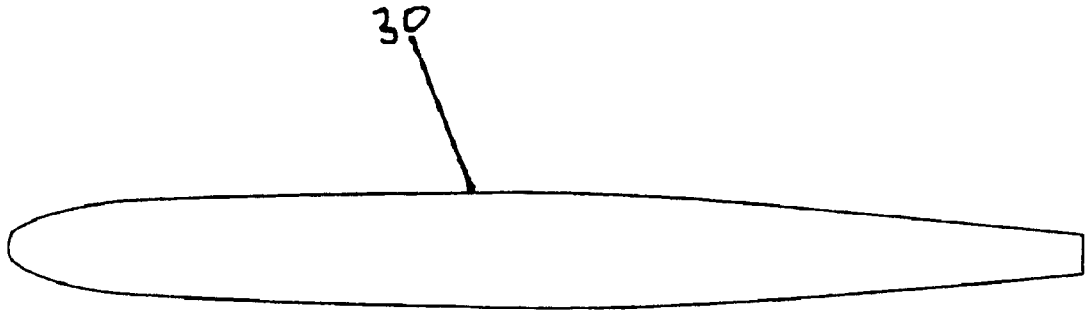
FIG. 2*a* shows a top view of a surf ski.
Figure 2B:
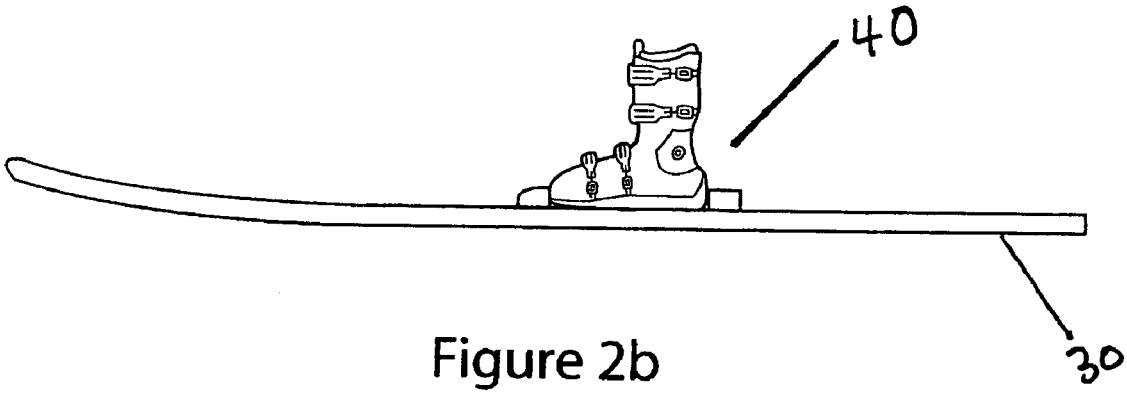
FIG. 2*b* shows a side view of a surf ski and releasable binding mechanism.

In the embodiment of FIG. 2*a,* the surf ski (30) is 63 inches long and 8 inches at its widest point in the center. The tail is roughly 3 inches wide and the tip is rounded to a dull point. In the side view, (FIG. 2*b*) the thickness of the ski is 0.75 inches, and the fiberglass cap rounds to the edge at a radius of 1.5 inches at the tip and 2 inches at the tail.

The width of the ski (30) can be 7-10 inches at its widest point to allow for a shoulder-width stance. The length can be 60-90 inches to maximize buoyancy and stability while maintaining desirable maneuverability.

The ski (30) narrows at the tail to about 3 inches and comes to a rounded tip that is about 2 inches wide. This shape—an elongated oval—helps the ski turn when planing on water, tipped on edge and pressured with body weight.

A side view of the surf ski (30) shows that it is turned up at the tip. This is sometimes called the surf ski's rocker and can be seen in FIG. 2*b.* The radius of the rocker is about 77.5 inches. The surf ski (30) has a generally flat profile from the tail toward the tip for about 80 percent of the ski and then curves upward at the rocker for the last 20 percent of length. A 63-inch ski is flat for 49.5 inches then turns upward at a radius of 77.5 inches. This shape, much like that of a surfboard or a traditional water ski, contributes to the ski's ability to turn when planing on a surface of water, tipped on edge and pressured with body weight.

According to another aspect of the present invention, the method of surf skiing includes getting into position to use the force of a wave (20) by being towed behind a motorized personal water craft or motor boat (60) using a rope (65), much like a traditional water skier. The motorized water craft (60) tows the surf skier (10) into a maturing wave (20). At the critical moment—that moment when the force of the wave (20) can support the surf skier (10) and move him on its own—the surf skier (10) drops the rope (65) that was attaching him to the motorized water craft (60) and continues riding the surf skis (30) as they are pushed along by the ocean wave (20). Using only the momentum of the wave (20), the surf skier (10) makes turns and does maneuvers (including aerial maneuvers) similar to the maneuvers seen in present-day alpine snow skiing.

Figure 1B:
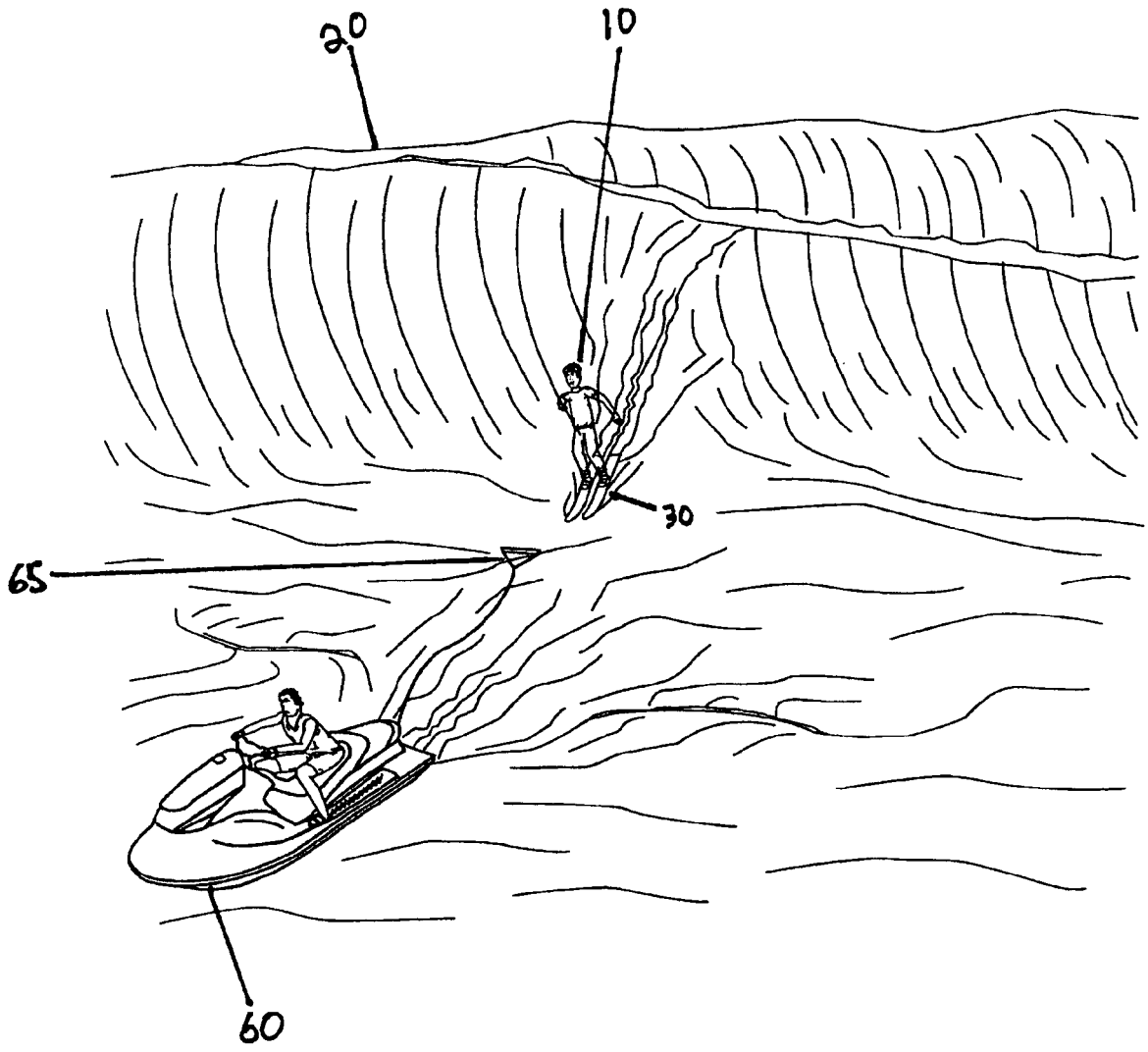
FIG. 1*b* shows a surf skier, having dropped a rope connecting him to a towing means, riding a mature wave.

Referring to FIG. 1*b,* the surf skier (10) has already been towed into the wave (20) by a motorized craft (60) and has dropped the rope (65) connecting him to that craft. The wave (20) is now the primary provider of force by which the surf skis (30) are floating and moving. The surf skis (30), having edge performance similar to that of alpine skis (FIG. 1*a*), have allowed the surf skier (10) to perform a right-handed turn off the lip of the wave (20).

When the wave (20) peters out and the ride is over, the skier (10) waits, floating in the water with the skis (30) still attached—or needing to reattach the skis (30) in the case of releasable bindings (40)—for the motorized water craft (60) to pull the skier (10) back into position for another ride.

Figure 5A:
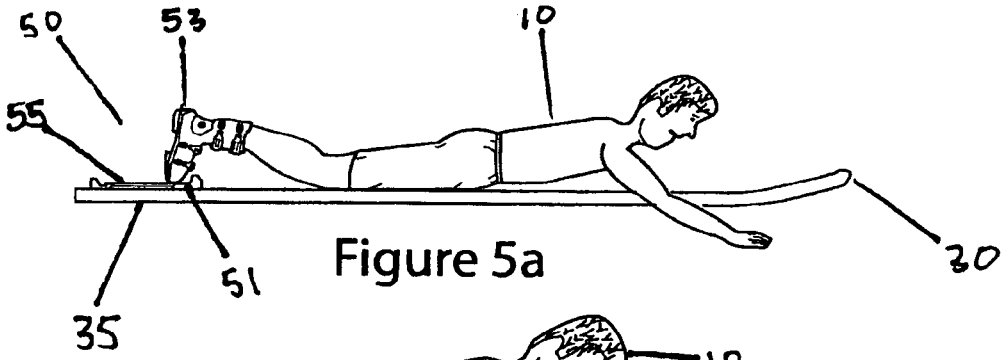
FIG. 5 shows the sliding binding system that allows the surf skier to lay prone on the skis for paddling into a wave then stand upright for surf skiing.
Figure 5B:
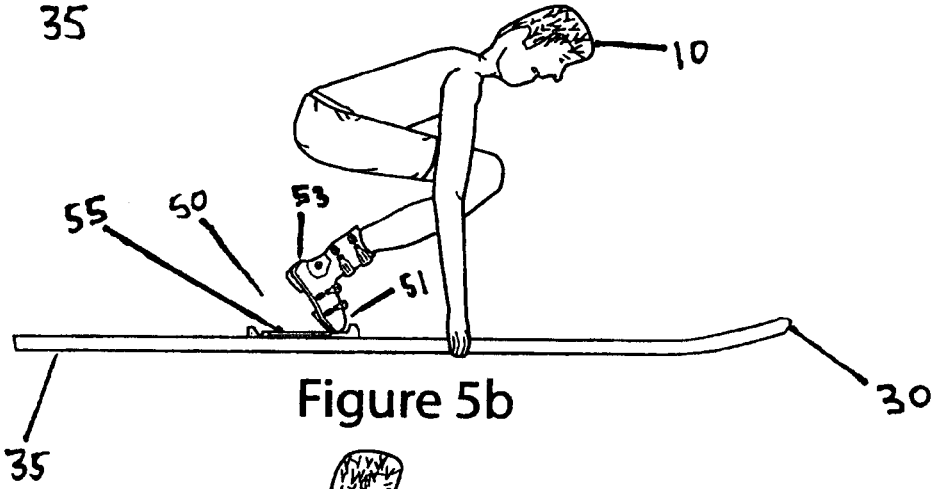
Figure 5C:
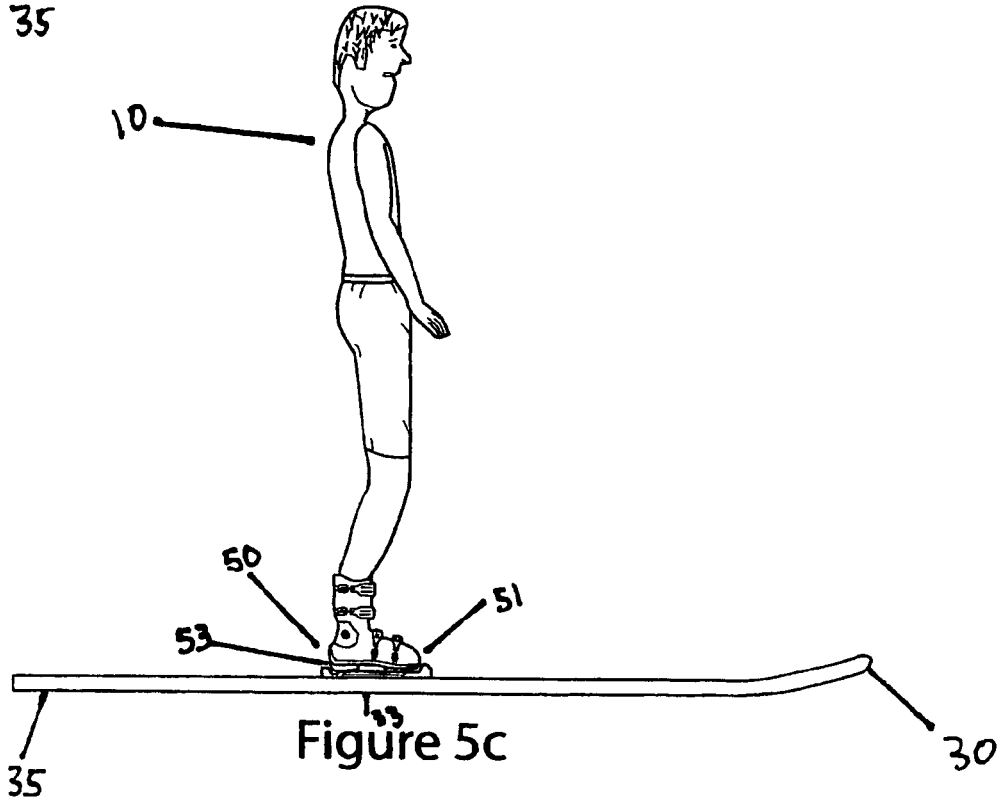

While the present invention has been disclosed using the surf skis (30) with fixed or releasable bindings (40), in an alternate embodiment, a sliding binding system (50) allows a surf skier (10) to paddle into waves (20) without the use of a motorized water craft or a tow rope. The sliding binding system (50) slides to the back (35) of the surf ski (30), pivoting from the toe (51) while releasing at the heel (53), to allow the surf skier (10) to lie prone on the top surface of the surf skis (30) in order to paddle to gain the initial velocity needed to ride a wave. The sliding binding system (50) then slides forward and clicks into a locked position at the heel (53) on the top surface of the ski (30) to allow for surf skiing in the standing position (FIG. 5).

Figure 6:
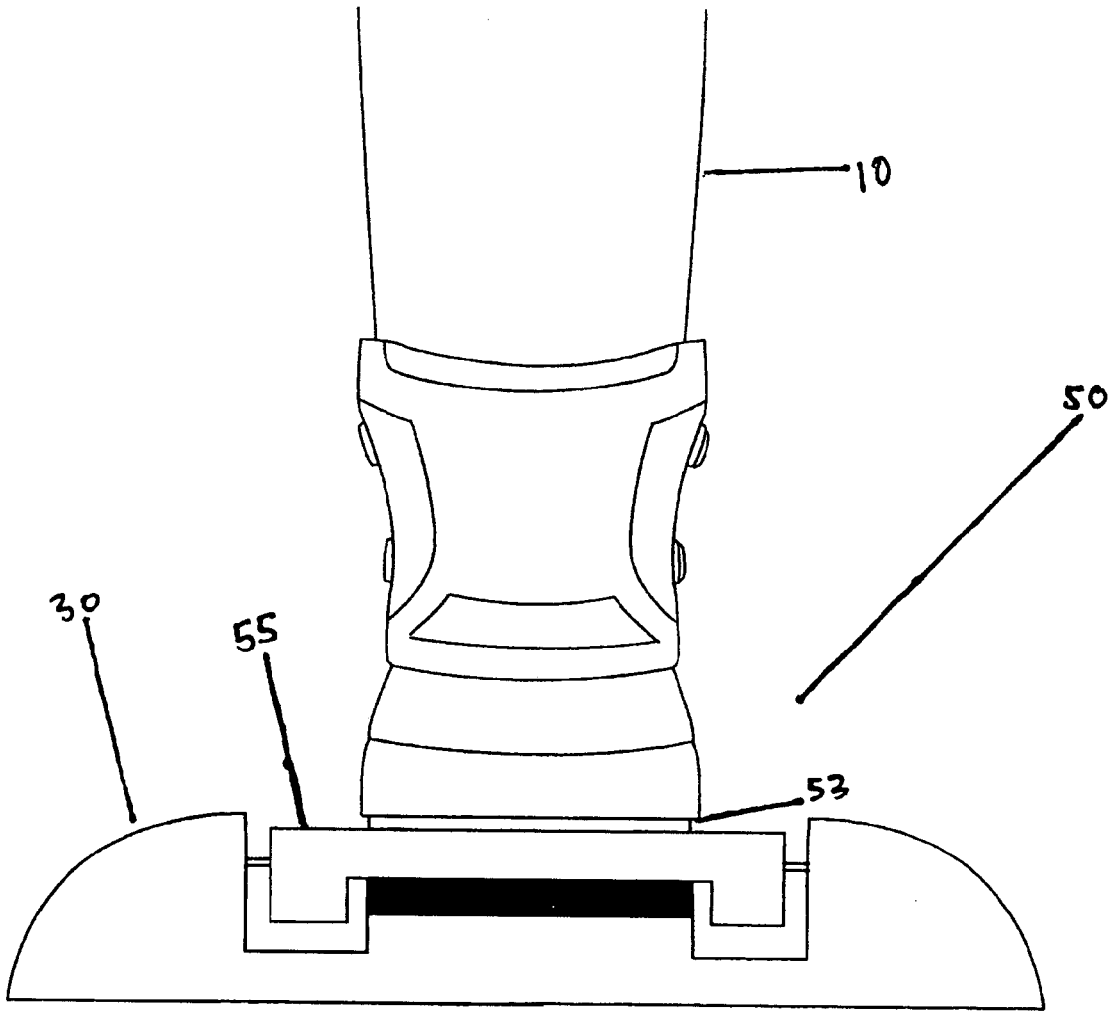
FIG. 6 shows a cross section view of a surf ski with the sliding binding system with a plate fitted into the top surface of the ski to allow for sliding of the binding system.

The sliding binding system (50) further comprises a sliding platform (55) in the top surface of the surf ski (30) (FIG. 6). The sliding platform (55) locks into place at the center (33) of the ski, allowing the binding (50), which is locked in at the heel (53) and toe (51) in this position, to provide stability for riding a wave (20). The sliding platform (55) also slides to the back of the ski (35), allowing the binding (50), which is released at the heel (53) and pivoted upward at the toe (51) in this position, to allow the surf skier (10) to lie prone (FIG. 5).

In another embodiment of the sliding binding mechanism (50), comprising a sliding platform (55), the surf skis (30) are attached (not shown) while the skier is in the prone position to allow for more stable paddling. When the skier (10) stands, and the sliding binding system (50) slides forward to a locked position in the center (33) of the ski (30), the sliding platform (55) triggers the release of the surf skis (30) back into two separate surf skis for riding and maneuvering on the wave (20).

In another embodiment of the invention, to the extent that the user of a self-propelled, nonmotorized set of water skis is able to propel himself with enough initial velocity to catch a wave (20), it should be considered part of the invention when that person is able to use the wave (20) as the primary provider of force by which the skis (30) are floating and moving.

Figure 3:
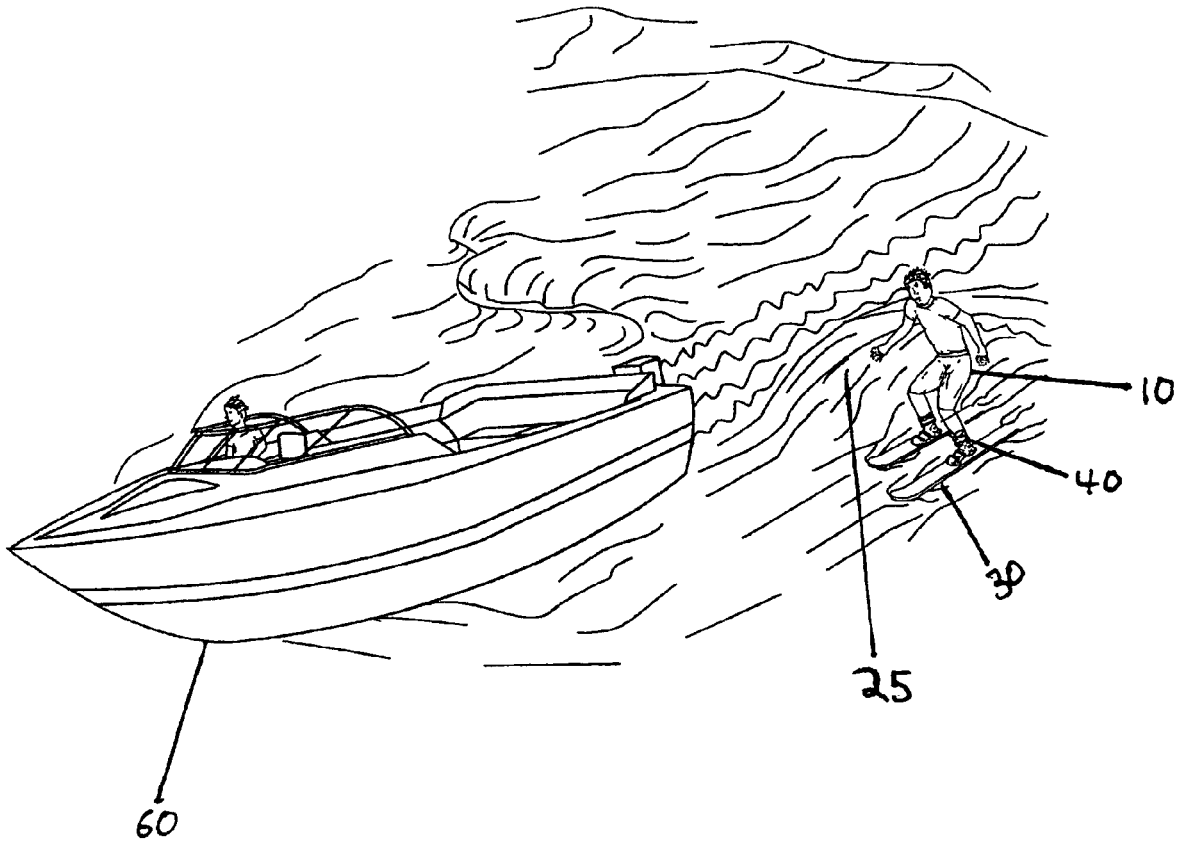
FIG. 3 shows a surf skier riding a generated wave created by a towing means from which the skier has disengaged.
Figure 4:
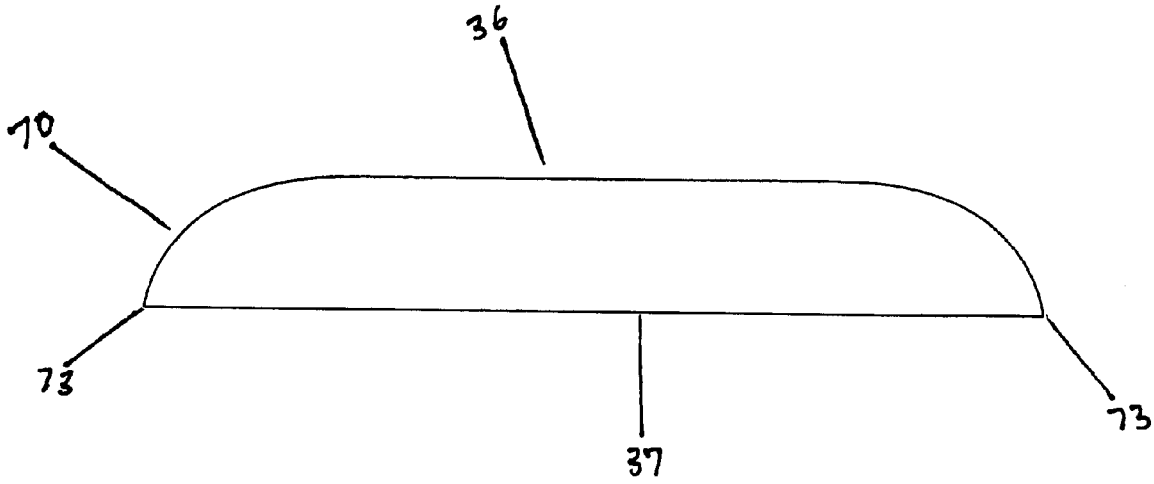
FIG. 4 shows a cross section of one embodiment of a surf ski, showing the top surface rounding to the bottom surface creating the surf ski's sharp edges.

While the present invention has been disclosed using the surf skis (30) on surf (20) (i.e. waves generated by tides and breaks), one is also able to use the present invention upon generated waves (25), such as those disclosed in U.S. Pat. Nos. 4,792,260; 5,911,190; 6,491,589, incorporated herein by reference (FIG. 3).

While the present invention has been disclosed using the surf skis (30) on surf (20) towed behind a motorized personal water craft or motor boat (60) to position the surf skier (10) on a wave (20) at the critical moment, the present surf skis will also be used as a conveyance for kite skiing as described in U.S. Pat. No. 5,366,182, incorporated herein by reference. Kite-powered surfing has become popular in the last half-decade, using a sideways-stance board such as a surf board or wakeboard as a conveyance. U.S. Pat. No. 5,366,182 also discloses the conveyance as a pair of traditional water skis. The skis of the present invention, however, improve the idea of kite-skiing because of the surf skis' greater buoyancy over traditional water skis and the use of a rigid binding system or releasable binding (40). The greater buoyancy makes kite-skiing possible at slower speeds and makes the launching of the kite easier in the water. The use of rigid or releasable bindings (40) makes the skis more responsive and maneuverable as compared to traditional water skis.

While the components and techniques of the present invention have been described with a certain degree of particularity, it is manifest that many changes may be made in the specific designs, constructions and methodology hereinabove described without departing from the spirit and scope of this disclosure. It should be understood that the invention is not limited to the embodiments set forth herein for purposes of exemplification, but is defined only by a fair reading of the appended claims, including the full range of equivalency to which each element thereof is entitled.

What is claimed is:

1. A method of surf skiing on a pair of buoyant skis, comprising the steps of:

providing a pair of buoyant skis, each ski having a sliding binding that adjustably allows a skier to change stance between prone and standing positions while attached to the ski, attaching each buoyant ski to each foot of the skier to buoyantly support the skier in a body of water, employing manual propulsion or motorized towing mechanism to transport the skier into a path of a developing or mature wave, suspending the manual propulsion or disengaging the skier from the motorized towing mechanism to position the skier in said predetermined path of the developing or mature wave, intercepting the wave to capture the energy of the wave and propel the skier along the wave substantially by the force of the wave alone.

2. The method of claim 1, wherein the towing mechanism is one of motorized boat, sailboat and personal watercraft.

3. The method of claim 1, wherein the skier suspends the manual propulsion or disengages from the towing mechanism substantially at the moment of intercepting the wave.

4. The method of claim 1, further comprising the step of the surf skier using the energy of the wave for carving turns.

5. The method of claim 4, further comprising the step of the surf skier using carving means for carving the turns.

6. The method of claim 1, wherein the wave is one of ocean wave, tidal wave and artificially created wave.

7. The method of claim 1, further comprising the step of the surf skier, upon falling or riding out the wave, reconnecting with the towing mechanism for being re-towed into position on a different wave.

8. The method of claim 1, wherein the towing mechanism is a kite.

9. A method of capturing the energy of water waves for surfing on a pair of buoyant skis, comprising the sequential steps of:

providing a pair of buoyant skis, each ski having a substantially planar bottom surface and a binding mechanism to secure the ski to the skier, attaching each buoyant ski to each foot of the skier with the binding mechanism to buoyantly support the skier in a body of water, identifying a developing or mature wave and employing motorized towing mechanism to advance the skier toward said identified developing or mature wave, deliberately disengaging the skier from the motorized towing mechanism at a critical moment when the skier is positioned on or is about to intercept said developing or mature wave, maneuvering for intercepting and capturing the energy of the wave so that the skier is propelled along the wave substantially by the force of the wave alone.

10. The method of claim 9, wherein the towing mechanism is one of motorized boat, sailboat and personal watercraft.

11. The method of claim 9, wherein the skier disengages from the towing mechanism substantially at the moment of intercepting the wave.

12. The method of claim 9, further comprising the step of the surf skier using the energy of the wave for carving turns.

13. The method of claim 12, further comprising the step of the surf skier using carving means for carving the turns.

14. The method of claim 9, wherein the wave is one of ocean wave, tidal wave and artificially created wave.

15. The method of claim 9, further comprising the step of the surf skier, upon falling or riding out the wave, reconnecting with the towing mechanism for being re-towed into position on a different wave.

16. The method of claim 9, wherein the binding mechanism is selected from the group consisting of a releasable binding mechanism, a non-releasable binding mechanism and a sliding binding mechanism.

17. The method of claim 16, wherein the sliding binding is adjustable for allowing the skier to change stance between prone and standing positions while attached to the ski.

18. The method of claim 9, wherein the towing mechanism is a kite.

* * * * *